United States Patent [19]

Jenkins

[11] Patent Number: 4,535,524

[45] Date of Patent: Aug. 20, 1985

[54] METHOD OF ASSEMBLING A RACK-SUPPORTING CHANNEL AND STOP

[75] Inventor: Thomas E. Jenkins, Louisville, Ky.

[73] Assignee: General Electric Company, Louisville, Ky.

[21] Appl. No.: 563,278

[22] Filed: Jan. 30, 1984

Related U.S. Application Data

[62] Division of Ser. No. 282,107, Jul. 10, 1981, Pat. No. 4,437,715.

[51] Int. Cl.[3] ..... B23P 11/02

[52] U.S. Cl. ..... 29/453; 29/526 R

[58] Field of Search ..... 29/453, 526 R, 451; 312/330 R, 311, 333, 348, 351

[56] References Cited

U.S. PATENT DOCUMENTS

| | | | |
|---|---|---|---|
| 2,127,230 | 8/1938 | Moineau | 29/453 X |
| 2,229,233 | 1/1941 | Wiley | 29/453 X |
| 2,758,904 | 8/1956 | Hansell et al. | 312/348 |
| 2,925,982 | 2/1960 | Moser | 29/453 UX |
| 3,023,925 | 3/1962 | Sher | 29/453 X |
| 3,158,284 | 11/1964 | Henchert et al. | 29/453 UX |
| 3,347,613 | 10/1967 | Krzewina | 312/333 |
| 3,775,830 | 12/1973 | Ryn et al. | 29/453 X |
| 3,809,450 | 5/1974 | Guth | 312/351 |
| 3,809,451 | 5/1974 | Pitstick | 312/351 |
| 3,822,085 | 7/1974 | Clark | 312/351 |
| 3,897,162 | 7/1975 | Havark | 29/453 X |
| 3,982,802 | 9/1976 | Bailey | 312/348 |
| 4,097,098 | 6/1978 | Fields | 312/311 |
| 4,190,306 | 2/1980 | Litchfield et al. | 312/330 |
| 4,300,109 | 11/1981 | Tanida | 29/453 X |
| 4,391,376 | 7/1983 | Finnegan | 29/453 X |

*Primary Examiner*—Charlie T. Moon

*Attorney, Agent, or Firm*—H. Neil Houser; Radford M. Reams

[57] ABSTRACT

A channel and stop arrangement for structures of the type containing racks or drawers supported from sliding or rolling support members carried in a channel, comprising an elongated channel member of generally C-shaped cross section adapted to receive the support members in its interior trackway and a stop member positioned in the end of the channel member to retain the support members in the trackway. The stop member comprises a cap portion of enlarged cross section joined to a rigid central body portion by a neck portion of reduced cross section and a lateral positioning tab extending from the central body portion. The tab is adapted to flex longitudinally relative to the central body portion between a normal position and an assembly position to facilitate insertion of the stop member into the channel and to rigidly oppose lateral motion relative to the central body portion to laterally retain the stop member in the channel. The channel member side wall has an indented portion formed near its front-facing end rigidly projecting into the trackway. When the stop is positioned in the channel, the indented portion extends between the cap portion and the central body portion to prevent longitudinal outward movement of the stop member, the indented portion and the central body portion providing sufficient structural rigidity to oppose longitudinal loads applied to the stop member by pull-out forces exerted on the rack or drawer.

3 Claims, 7 Drawing Figures

METHOD OF ASSEMBLING A RACK-SUPPORTING CHANNEL AND STOP

This application is a division of application Ser. No. 282,107, filed July 10, 1981, now U.S. Pat. No. 4,437,715.

BACKGROUND OF THE INVENTION

This invention relates to a rack-supporting channel and stop arrangement for front-opening structures containing an article-supporting rack or drawer supported from rollers carried in a channel or slide for inward and outward movement relative to the structure. This invention is particularly advantageously used with front-loading appliances such as automatic dishwashers having dish racks supported by channel members mounted to the side walls of the dishwasher for retaining the rollers carrying the dishwasher rack within the channel.

Commercially available front-loading automatic dishwashers have an upper dish rack while is typically supported from the side walls of the dishwasher wash chamber to permit inward and outward movement of the dish rack. One known support structure arrangement employs a dish rack supported from rollers mounted to the rack itself. A pair of rack-supporting channels of generally C-shaped cross section are disposed on opposing side walls within the wash chamber, each being supported from rollers rotatably mounted to the wash chamber wall spaced apart in rectangular orientation with upper and lower rows of rollers. The rack-supporting rollers are received within a trackway formed in the interior of the channel. The internal trackway is necessarily blocked by a plastic clip or other means to retain the rack-supporting rollers within the trackway.

Snap-in plugs or caps are attractive blocking means for such trackways because of the relative ease of assembly and low fabrication cost. However, the potentially substantial pull-out forces to which the rack may be subjected also tend to undesirably snap out conventional snap-in type caps.

One alternative type of blocking means which avoids the snap-out problem is described in U.S. Pat. No. 4,097,098 to Field. As taught by Field, the blocking means comprises a bumper member inserted in each end of the rack-supporting channel. The bumper member is held in position by a retaining pin which passes through both the channel and the bumper member. A locking tab formed integrally with the bumper member extends over the head of the retainer pin to retain it in its position.

Such an arrangement employing multiple parts is relatively costly and complex to assemble. What is needed is a cap or plug which provides sufficient structural rigidity to resist the potentially substantial pull-out forces but having the cost and assembly advantages of a snap-in plug.

It is therefore an object of the present invention to provide a rack-supporting channel and stop arrangement employing a one-piece, integrally formed stop member which provides the fabrication and assembly advantages of a snap-in plug while also providing the necessary rigidity to withstand the normal pull-out load.

SUMMARY OF THE INVENTION

In accordance with an illustrative embodiment of the present invention, a front-loading dishwashing appliance having an upper dish rack carried by rack-supporting rollers for inward and outward movement of the rack relative to the dishwasher wash chamber incorporates an improved rack-supporting channel and stop arrangement. The channel and stop arrangement essentially comprises a rack-supporting, elongated channel member of generally C-shaped cross section adapted to receive the rack-supporting rollers in the trackway formed by the interior of the channel member and a stop member positioned in the front-facing end of the channel member to limit the outward travel of the rack-supporting rollers in the trackway. The stop member is integrally molded of a plastic material and comprises a cap portion of enlarged cross section joined to a rigid central body portion by a neck portion of reduced cross section and a lateral positioning member or tab extending generally inwardly from said central body portion. The lateral positioning member is adapted to flex longitudinally relative to the central body portion and to rigidly oppose lateral motion relative to the central body portion. The lateral positioning member is flexibly movable between a normal position and an assembly position and is self-biased to its normal position. The channel member has formed near its front-facing end a retainer means projecting into the trackway. When the channel and stop are assembled, the retainer means projects toward the neck portion of the stop member into the gap between the cap and the central body portion with the central body portion extending laterally behind the retainer means. The interaction between the rigid retainer means and the rigid central body portion provides sufficient structural rigidity to oppose longitudinal loads applied to the stop member by pull-out forces exerted on the dish rack.

Assembly of the channel and stop arrangement is facilitated by the flexible lateral positioning member. In its normal position, the lateral positioning member substantially spans the trackway between the uppermost and lowermost interior curved wall portions of the channel member thereby limiting lateral movement of the stop member relative to the channel member. When flexed to its assembly position, however, the lateral positioning member is sufficiently remote from at least one of the curved portions of the channel member to permit lateral movement of the stop member relative to the channel member. Thus, by flexing the lateral positioning member to its assembly position, the stop member may be inserted laterally into the trackway formed by the channel member. Upon return to its normal position, the lateral positioning member rigidly opposes lateral movement of the stop member. Thus, when assembled, the stop member is secured laterally by the capture of the lateral positioning member within the curved wall portions of the channel member; secured against inward movement by the cap portion abutting the front-facing end of the channel member; and secured against an outward movement by engagement of the central body portion with the channel member retainer means. The stop member is thus assembled with the ease of a snap-in plug, yet opposes longitudinal loads applied to the stop member by the rack-supporting rollers resulting from outward movement of the rack by the interaction of the rigid central body portion of stop member with the rigid retainer means of the channel member.

DETAILED DESCRIPTION OF THE ILLUSTRATIVE EMBODIMENT

The channel and stop arrangement of the present invention may be employed in a variety of rack or drawer supporting structures. The description to follow is directed to its use in a dishwashing appliance for which it has been found to be particularly advantageous.

Figure 1:
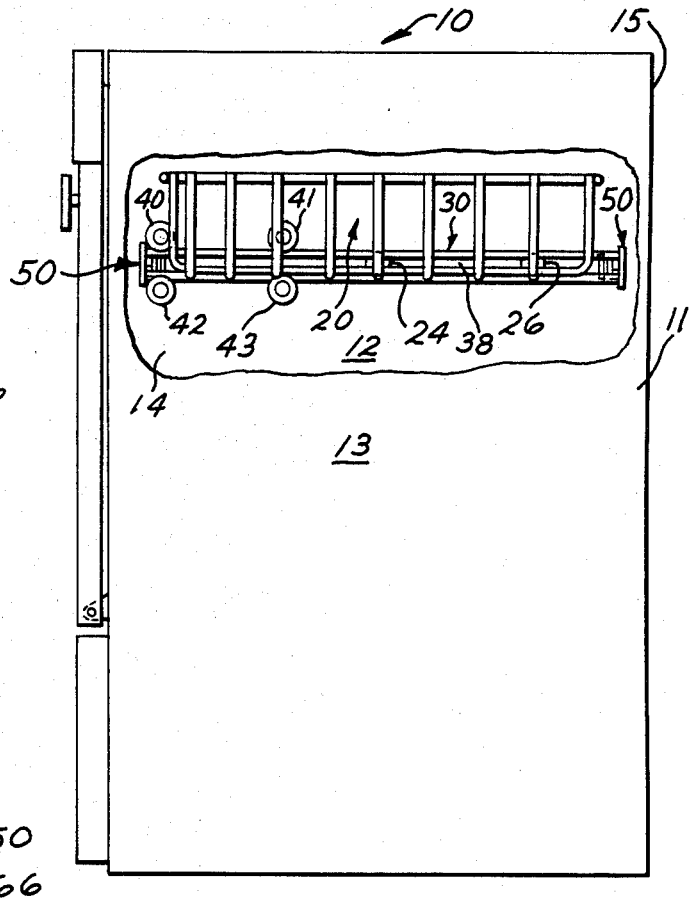
FIG. 1 is a side view of a front-loading dishwashing appliance with a portion of the side wall broken away to show a dishwasher supporting rack within the wash chamber.

In FIG. 1, there is illustrated an automatic dishwashing machine 10 having an enclosure or cabinet 11 surrounding a wash chamber 12. The wash chamber 12 is enclosed by oppositely disposed side walls 13 and 14, a back wall 15, and an access door 16 hinged to open outwardly and downwardly, thereby providing access to the front-opening wash chamber 12. An upper dish-supporting rack 20 is mounted within wash chamber 12 for receiving dishes and other articles to be washed in the dishwashing appliance. Upper rack 20 has a basket-like open framework configuration formed from wire rod elements welded in a predetermined arrangement in a conventional manner.

Dish rack 20 is supported in wash chamber 12 from side walls 13 and 14 by a supporting structure which is duplicated at each side of the wash chamber 12 in a mirror image reversal of parts so that each side of the rack 20 is similarly supported. The description of the supporting structure and interaction of the various parts is directed to that supporting one side of rack 20. However, it should be realized that the description is equally applicable to the supporting structure at either side of the rack and wash chamber.

Figure 2:
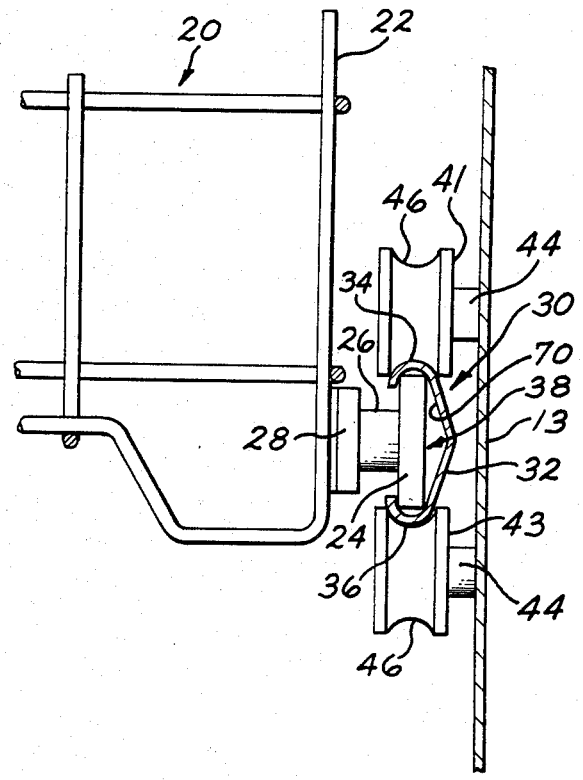
FIG. 2 is an enlarged fragmentary sectional front elevational view of a portion of the dish rack and supporting structure of the dishwasher of FIG. 1.

Dish rack 20 is carried on horizontally displaced dish rack supporting members in the form of rollers 24 for inward and outward movement of dish rack 20 relative to the wash chamber. As best seen in FIG. 2, each dish rack-supporting roller 24 is journalled to rotate on a corresponding axial member 26 projecting laterally from a mounting bracket 28 which is suitably secured to rack 20 such as by spot welding. It is understood that while rollers are preferred for the dishwasher embodiment, non-rotating sliding members may also be used in combination with the channel and stop arrangement.

An elongated rack-supporting channel member 30 adapted to supportingly receive rollers 24 is slidably mounted to each of side walls 13 and 14 substantially horizontally and parallel to the side walls 14 by rollers 40, 41, 42 and 43.

As best seen in FIG. 2, each rack-supporting channel member 30 has a side wall portion 32 and upper and lower curved wall portions 34 and 36, respectively, converging toward each other to define an open-ended, elongated internal trackway 38 of generally C-shaped cross section. Internal trackway 38 of channel member 30 is adapted to receive rack-supporting rollers 24. A stop member designated generally 50 is inserted in each end of channel member 30 (see FIG. 1). Stop members 50 serve to prevent rollers 24 from passing out of the track when rack 20 is moved in and out of wash chamber 12.

Rollers 40, 41, 42 and 43 are spaced apart in a rectangular orientation on wash chamber wall 13 and each is journalled to rotate on a corresponding one of studs 44 projecting laterally from chamber wall 13. Each of rollers 40–43 has an annular groove 46 formed about its periphery. The outer surface of curved wall portions 34 and 36 of channel member 30 substantially conform to annular grooves 46 in each of the rollers 30, 41, 42 and 43.

Rack-supporting channel member 30 is slidably mounted between upper rollers 40 and 41 and lower rollers 42 and 43. In this fashion channel member 30 is disposed substantially horizontally and parallel to wash chamber side wall 13 and is adapted to slide forwardly and rearwardly on rollers 40, 41, 42 and 43.

Figure 4:
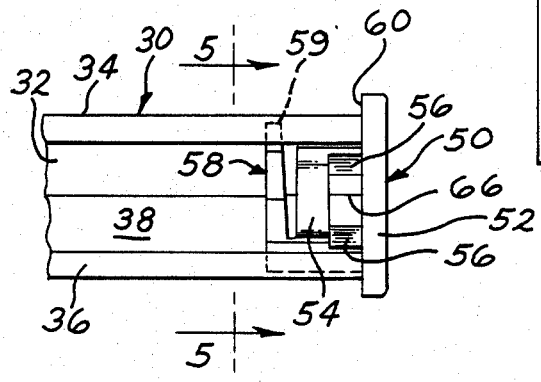
FIG. 4 is a fragmentary side elevational view of the fully assembled channel member and stop member assembly of FIG. 3.
Figure 3:
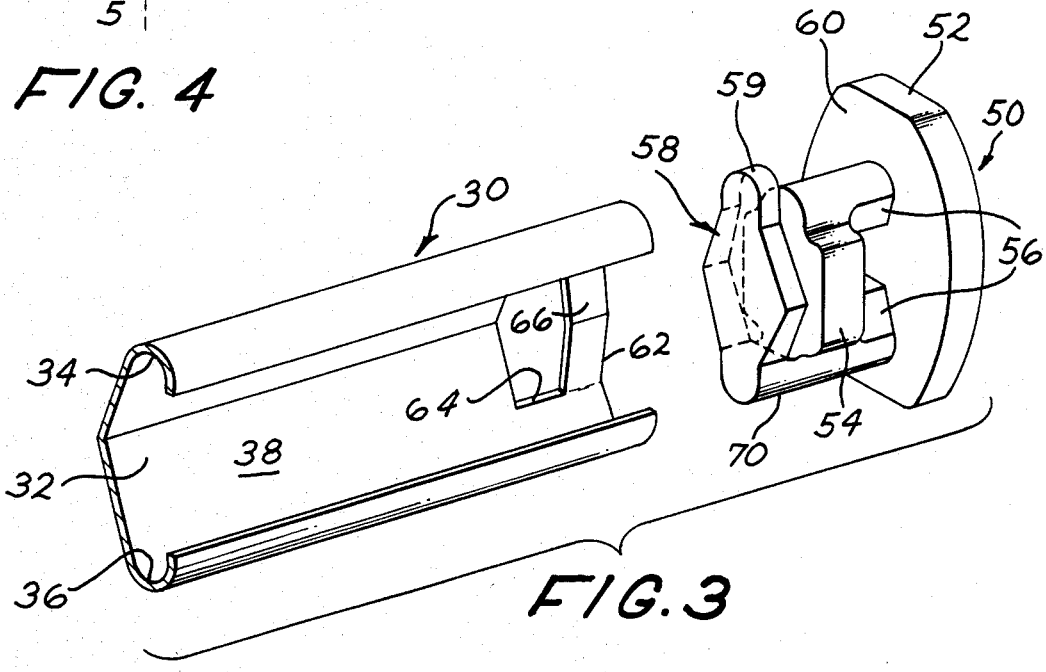
FIG. 3 is an exploded perspective view of the front-facing end portion of a rack-supporting channel member and stop member assembly illustratively embodying the present invention.
Figure 5:
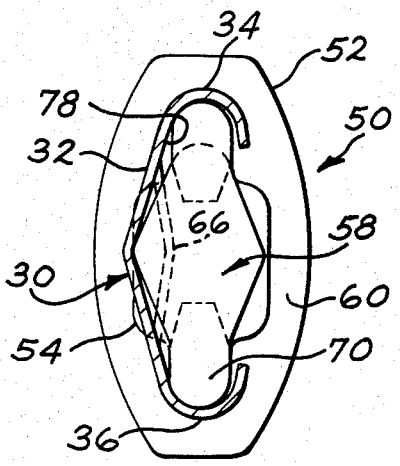
FIG. 5 is a cross-sectional view of the channel member and stop member of FIG. 4 taken along lines 5—5.

Referring now to FIG. 3, the channel and stop member assembly illustratively embodying the present invention will be described in greater detail. Stop member 50, preferably integrally formed of a moldable plastic material such as polypropylene, comprises a cap portion 52 of enlarged cross section, a rigid central body portion 54 joined to cap portion 52 by a neck portion 56 of reduced cross section. A lateral positioning member or tab 58 extends from body portion 54. Channel member 30 has an aperture 64 formed near its front facing end 62. A retaining means 66 is formed by indenting the portion of side wall 32 of channel member 30 between aperture 64 and end 62. As seen in FIGS. 4 and 5, when assembled, the inner face 60 of cap portion 52 abuttingly engages the front-facing end 62 of channel member 30 and central body portion 54 extends laterally into aperture 64 behind retaining means 66. When so assembled, retaining means 66 is positioned to blockingly engage the rigid central body portion 54 and thereby prevent longitudinal outward movement of stop member 50 relative to channel member 30. It will be apparent that even without indenting side wall 32 to form the retaining means, projection of central body portion 54 through aperture 64 serves to limit longitudinal movement of stop member 50. However, when subjected to particularly heavy loads central body portion 54 may twist out of aperture 64. Retaining means 66, by projecting sufficiently into the trackway, precludes stop member 50 from twisting out of blocking engagment therewith even under heavy loads. Lateral positioning member 58 of stop member 50 substantially spans trackway 38 from the lowermost interior of curved portion 36 to the uppermost interior upper curved portion 34 of channel member 30 such that lateral positioning member 58 is laterally captured in the uppermost and lowermost curved portions of channel member 30 so as to limit lateral movement of stop member 50 relative to channel member 30.

Outward movement of the dish rack supporting rollers presents the primary load to be opposed or supported by stop member 50. Such loads can be on the order of 100 lbs. In the arrangement of this invention, when assembled, stop member 50 is secured both laterally and longitudinally in trackway 38. Stop member 50 is secured laterally by the capture of lateral positioning member 58 within the upper and lower curved portions 34 and 36, respectively, of channel member 30; longitudinally inwardly by engagement of cap portion 52 with the front-facing end of channel member 30; and longitudinally outwardly by engagement of central body portion 54 with retainer means 66 of channel member 30. Consequently this primary load, which is applied to the stop member essentially in the longitudinal outward direction, is substantially supported by the engagement of the rigid central body portion 54 of stop member 50 with the rigid retainer means 66 of channel member 30.

Figure 6:
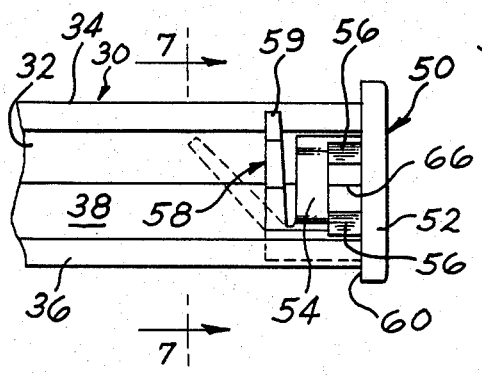
FIG. 6 is a fragmentary side elevational view of the channel member with the stop member partially inserted showing the normal and assembly positions of the positioning tab of the stop member.

Assembly of the channel member and stop arrangement is facilitated by the longitudinal flexibility of lateral positioning member or tab 58 of stop member 50. The thickness of lateral positioning member 58 permits flexing of positioning member 58 from its normal position shown in FIG. 4 to its assembly position shown in phantom in FIG. 6. However, the inherent resiliency of the stop member material self-biases the positioning member to its normal position. When flexed to its assembly position, the free end 59 of lateral positioning member 58 is sufficiently remote from upper curved portion 34 of channel member 30 to clear the curved portion permitting lateral movement of stop member 50 relative to channel member 30.

Figure 7:
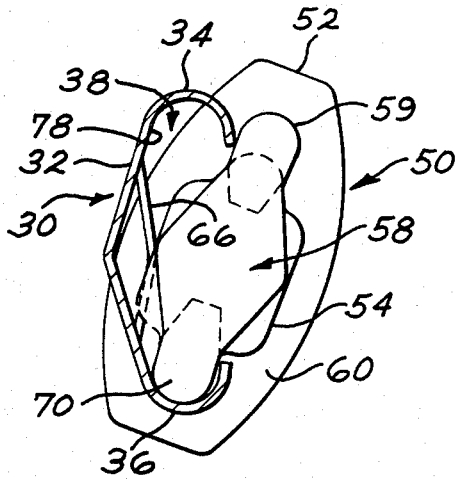
FIG. 7 is a cross-sectional view of the channel member and stop member of FIG. 6 taken along lines 6—6 with the positioning tab in its normal position.

To position stop member 50 in trackway 38 of channel member 30, the stop member 50 is canted relative to channel member 30 as shown in FIG. 7 with a first portion 70 of stop member 50 positioned in the lower curved portion 36 of channel member 30 and the inner-face 60 of cap portion 52 abuttingly engaging front-facing end 62 of channel member 30. Lateral positioning member 58 is then flexed to its assembly position as shown in phantom in FIG. 6 such that free end 59 of positioning member 58 clears the upper curved wall portion 34 of channel member 30. Stop member 50 is then rotated about its lowermost portion 70 counterclockwise as seen in FIG. 7 into engagement with the interior face 78 of side wall 32 of channel member 30 with central body portion 54 extending laterally behind retainer means 66 through aperture 64. Release of positioning member 58 permits it to return to its normal position, laterally captured within the upper and lower curved wall portions of the channel member, as shown in full lines in FIG. 6. It is, of course, to be understood that assembly could also be satisfactorily accomplished by initially inserting portion 70 of stop member 50 into the upper curved portion 34 and rotating member 50 clockwise about portion 70 into the trackway 38.

It should be apparent that the channel member and stop member arrangement of the present invention provides the assembly advantages of a snap-in plug and the structural advantages of a rigidly secured plug member by employing a resilient positioning member which flexes to facilitate assembly and a rigid load-bearing member to oppose the primary loading forces.

While a specific illustrative embodiment of the invention has been illustrated and described herein, it is realized that modifications and changes will occur to those skilled in the art. For example, the flexible lateral positioning member may comprise a pair of oppositely extending tabs extending from the mid portion of the central body portion with one tab extending upwardly and the other downwardly rather than a single positioning tab as described herein. The method for positioning such a stop member in the channel member would comprise placing the central body portion adjacent the trackway; flexing both tabs away from respective upper and lower curved portions of the channel member; moving the central body portion laterally into engagement with the side wall of the channel member; and releasing both tabs for return to their normal position substantially spanning the trackway. It is therefore to be understood that the appended claims are intended to cover all such modifications and changes as fall within the true spirit and scope of the invention.

What is claimed is:

1. A method of assembling a rack-supporting channel and stop arrangement for a structure providing a chamber having a front opening and side walls wherein there is an article-holding rack supported by rack-supporting members for inward and outward movement of the rack relative to the structure, the rack-supporting members being carried in a trackway of an elongated channel member having a side wall and upper and lower curved walls converging toward each other defining a substantially C-shaped cross section and having one end facing the front opening of the chamber comprising the steps of:

deforming a portion of the channel member side wall near its front-facing end to project inwardly into the trackway to form a retaining means; and inserting a stop member into the front opening of the channel member, the stop member having a cap portion of enlarged cross section and a central body portion joined to the cap section by a neck portion of reduced cross section and a lateral positioning member resilient in the longitudinal direction and rigid in the lateral direction extending from the central body portion, self-biased to a normal position and flexibly movable to an assembly position, and constructed to substantially span the trackway between the uppermost and lowermost interior faces of the curved wall portions of the channel member when in its normal position and to clear that portion of the trackway within one of the curved wall portions and the side wall portion of the trackway when flexed to its assembly position, insertion of the stop member comprising the steps of canting the stop member laterally relative to the channel member away from the trackway;

inserting a first portions of the central body portion within one of the curved portion of the trackway with the inner face of the cap portion abuttingly engaging the front-facing end of the channel member and the central body portion extending inwardly beyond the retainer means;

flexing the lateral positioning member to its assembly position;

rotating the stop member about its first portion into abutting engagement with the interior side wall portion of the channel member with the central body portion extending laterally behind the retainer means;

releasing the lateral positioning member for return to its normal position, thereby securing the stop member laterally by the capture of lateral positioning member within the curved wall portions of the channel member, inwardly by the cap portion abutting the front-facing end of the channel member, and outwardly by engagement of the central body portion with the channel member retainer means.

2. A method of assembling a rack-supporting channel and stop arrangement for a structure providing a chamber having a front opening and side walls wherein there is an article-holding rack supported by rack-supporting members carried in the trackway of an elongated channel member for inward and outward movement of the rack relative to the chamber, the channel member having a side wall portion and upper and lower curved wall portions converging toward each other defining a substantially C-shaped cross section and having an open end facing the front opening of the chamber comprising the steps of:

deforming a portion of the channel member side wall near its front-facing end to form a retainer means projecting inwardly into the trackway; and positioning a stop member having a cap portion of enlarged cross section, a central body portion joined to the cap portion by a neck portion of reduced cross section and a flexible positioning tab extending from the central body portion and constructed to substantially span the trackway between the interior faces of the curved wall portions of the channel member when in its normal position in the trackway, into the front opening of the channel member by:

canting the stop member laterally away from the trackway;

positioning a first portion of the central body portion of the stop member in one curved portion of the channel member with the cap portion of the stop member abuttingly engaging the front-facing end of the channel member;

flexing the flexible positioning tab of the stop member inwardly to clear the other curved wall portion of the channel member;

rotating the stop member about its first portion into engagement with the interior face of the side wall of the channel member with the central body portion extending laterally behind the retainer means; and releasing the self-biased flexible tab for return to its normal position, thereby securing the stop member laterally by capture of the tab within the upper and lower curved wall portions of the channel member, inwardly by engagement of the cap portion with the front-facing end of the channel member and outwardly by engagement of the central body portion with the retainer means.

3. A method of assembling a rack-supporting channel and stop arrangement for a structure providing a chamber having a front opening and side walls wherein there is an article-holding rack supported by supporting members carried in the trackway of an elongated channel member for inward and outward movement of the rack relative to the chamber, the channel member having a side wall portion and upper and lower curved wall portions converging toward each other defining a substantially C-shaped cross section and having an open end facing the front opening of the chamber comprising the steps of:

deforming a portion of the channel member side wall near its front-facing end to form a retainer means projecting inwardly into the trackway; and positioning a stop member having a cap portion of enlarged cross section, a central body portion joined to the cap portion by a neck portion of reduced cross section and a flexible positioning tab extending from the central body portion into the front opening of the channel member by:

positioning the central body portion adjacent the trackway with the cap portion of the stop member abuttingly engaging the front-facing end of the channel member;

flexing the flexible positioning tab member inwardly to clear at least one of the curved wall portions of the channel member;

moving said central body portion generally laterally into the trackway into engagement with the interior face of the side wall of the channel member with the central body portion extending laterally behind the retainer member; and releasing the self-biased flexible tab for return to its normal position, thereby securing the stop member laterally by capture of the tab within the upper and lower curved wall portions of the channel member, inwardly by engagement of the cap portion with the front-facing end of the channel member and outwardly by engagement of the central body portion with the retainer means.

* * * * *